United States Patent [19]

Callerio et al.

[11] Patent Number: 4,984,964

[45] Date of Patent: Jan. 15, 1991

[54] PUMP FOR REFRIGERATION SYSTEMS, IN PARTICULAR FOR AERONAUTICAL APPLICATIONS

[75] Inventors: Antonio Callerio; Vincenzo Callerio, both of Milan, Italy

[73] Assignee: F.I.M.A.C. Fabbrica Italiana Macchine Aria Compressa S.p.A., Senago, Italy

[21] Appl. No.: 362,791

[22] Filed: Jun. 7, 1989

[30] Foreign Application Priority Data

Jun. 15, 1988 [IT] Italy ..... 20976 A/88

[51] Int. Cl.[5] ..... F04D 29/00

[52] U.S. Cl. ..... 415/55.4; 415/55.6; 415/98; 415/199.2; 416/223 A

[58] Field of Search ..... 415/55.1, 52.1, 55.4, 415/55.5, 55.6, 97, 98, 198.1, 199.1, 199.2, 199.3, 212.1, 203, 204, 224; 416/223 R, 223 A

[56] References Cited

U.S. PATENT DOCUMENTS

| | | | |
|---|---|---|---|
| 1,665,687 | 4/1928 | Derrick | 415/55.4 |
| 1,768,242 | 6/1930 | Ferguson | 415/55.1 |
| 1,972,548 | 9/1934 | Brady | 415/203 |
| 2,003,350 | 6/1935 | Durdin | 415/55.5 |
| 2,604,852 | 7/1952 | Baker | 415/55.1 |
| 2,842,062 | 7/1958 | Wright | 415/55.4 |
| 3,932,057 | 1/1976 | Wadensten | 415/198.1 |
| 4,204,800 | 5/1980 | Bentele et al. | 415/55.5 |
| 4,251,183 | 2/1981 | Liu et al. | 415/198.1 |
| 4,591,311 | 5/1986 | Matsuda et al. | 415/55.5 |
| 4,668,160 | 5/1987 | Mase et al. | 415/90 |
| 4,799,855 | 1/1989 | Miloco et al. | 415/198.1 |

FOREIGN PATENT DOCUMENTS 2036870 7/1980 United Kingdom .

*Primary Examiner*—Edward K. Look
*Assistant Examiner*—Hoang Nguyen
*Attorney, Agent, or Firm*—Guido Modiano; Albert Josif

[57] ABSTRACT

This pump for refrigerating systems, in particular for aeronautical applications, comprises a pump body accommodating an impeller rotatable about a main axis; the impeller is substantially disk-shaped and has, on at least one of its faces, a plurality of radial blades arranged along a circular crown which is concentric to the main axis. The radial blades are accommodated in an annular duct which extends in the pump body concentrically to the main axis and is axially delimited, on one side, by the blade bearing face of the impeller; the annular duct has an intake port and a delivery port which are angularly spaced with respect to the main axis for the inflow and outflow of a fluid and is closed in an axial direction at least in the region not affected by the ports, so that when the impeller rotates the fluid advances along the annular duct from the intake port to the delivery port forming vortices about the circumference defined by the annular duct.

7 Claims, 2 Drawing Sheets

PUMP FOR REFRIGERATION SYSTEMS, IN PARTICULAR FOR AERONAUTICAL APPLICATIONS

BACKGROUND OF THE INVENTION

The present invention relates to a pump for refrigerating systems, in particular for aeronautical applications.

As is known, axial or centrifugal pumps are used in refrigerating systems to compress the working fluid, which is generally freon. Such pumps have a pumping capacity $$C = \frac{\Delta p}{\frac{1}{2}\rho V_p^2}$$

(where $\Delta p$ is the obtainable pressure difference, $\rho$ is the density of the working fluid and $V_p$ is the impeller peripheral speed) which is relatively low, and therefore when high pressure differences are required in the refrigerating cycle, i.e. when the difference between the condensation temperature and the evaporation temperature is large, it is necessary to use multiple compression stages and/or pumps with an impeller driven at a high rotation rate. In refrigerating systems for aeronautical applications, used for example to refrigerate electronic components, high pressure differences are required. However, in this particular application it is necessary to provide very compact refrigerating systems in order to keep their weight within acceptable limits. Therefore the use of centrifugal or axial pumps is troublesome since the required number of compression stages and/or the use of high-speed electric motors considerably increases the overall weight of the refrigerating system.

Furthermore, in view of the variability of the demand of condensed fluid, said fluid very often enters the first compression stage while it is still liquid, causing the breakage or malfunction of the pump and entailing the use of additional devices, such as for example safety valves, with the effect of further increasing the weight of the system.

SUMMARY OF THE INVENTION

The aim of the present invention is to solve the above described problems by providing a pump for refrigerating systems which has a considerably greater pumping capacity than known pumps, so as to allow the manufacture of low-weight refrigerating systems particularly suitable for aeronautical applications.

Within this aim, an object of the invention is to provide a pump which can achieve the pressure differences required in this kind of application with a reduced number of compression stages and with the use of low-weight motors with respect to conventional centrifugal or axial pumps.

Another object of the invention is to provide a pump which can operate without requiring the use of additional devices even in the presence of a two-phase fluid.

This aim, these objects and others which will become apparent hereinafter are achieved by a pump for refrigerating systems, as defined in the appended claims.

BRIEF DESCRIPTION OF THE INVENTION

The characteristics and advantages of the invention will become apparent from the description of a preferred but not exclusive embodiment of the pump according to the invention, illustrated only by way of non-limitative example in the accompanying drawings, wherein.

DESCRIPTION OF THE PREFERRED EMBODIMENTS

Figure 1:
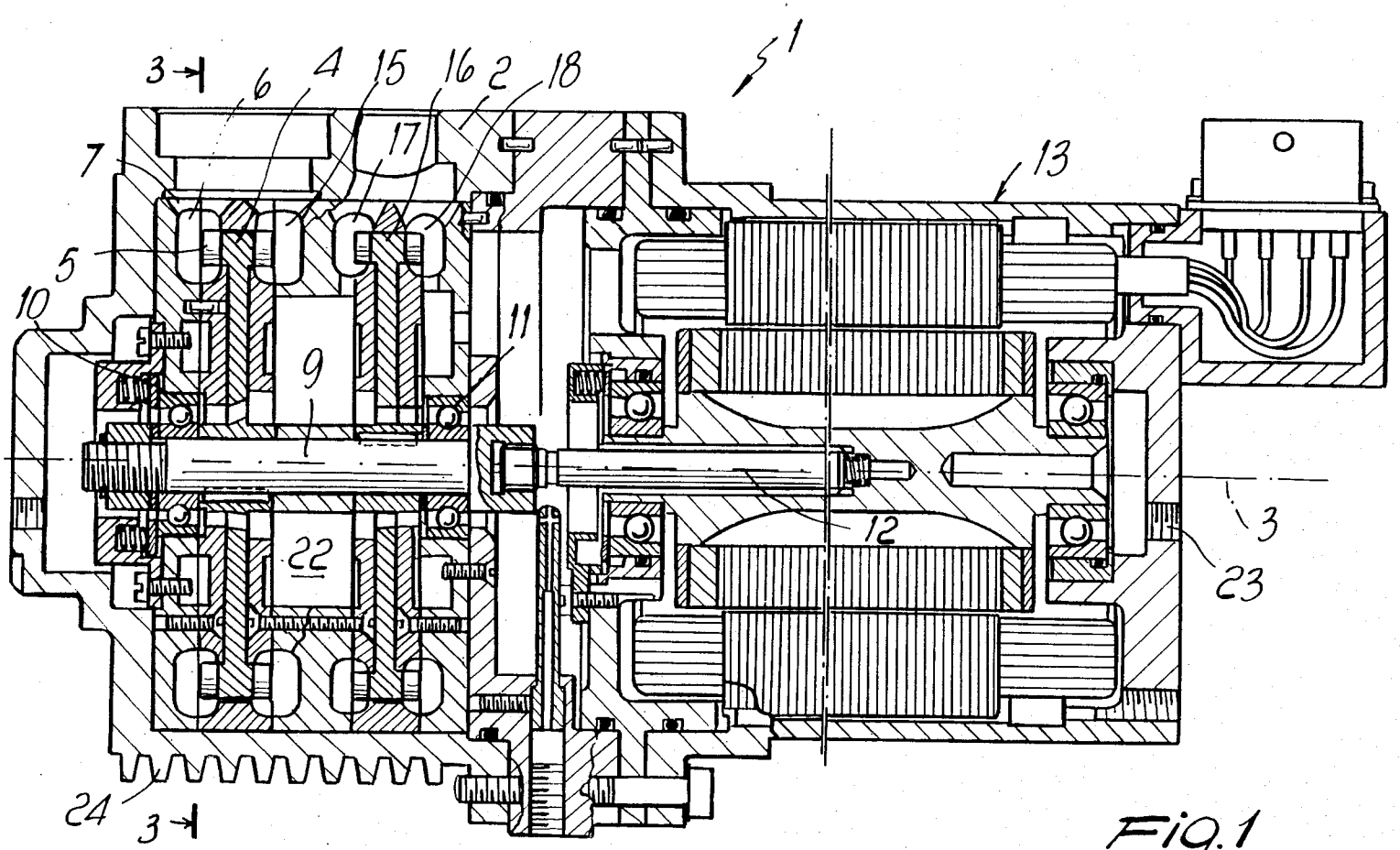
FIG. 1 is an axial sectional view of a pump according to the invention.
Figure 2:
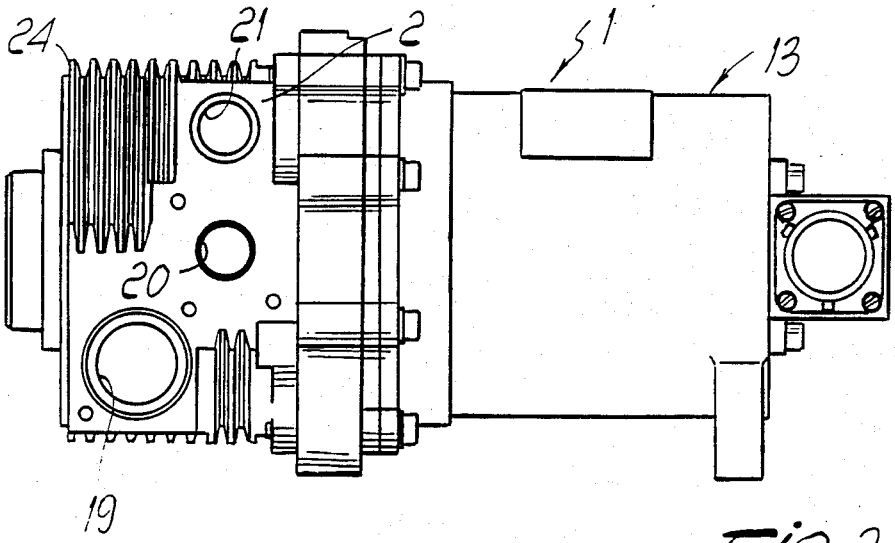
FIG. 2 is a reduced-scale top plan view of the pump.
Figure 4:
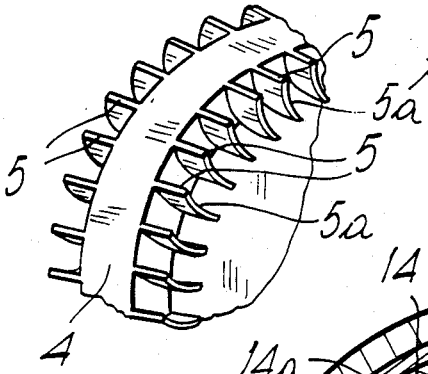
FIG. 4 is a perspective view of a portion of the impeller of the pump according to the invention.
Figure 3:
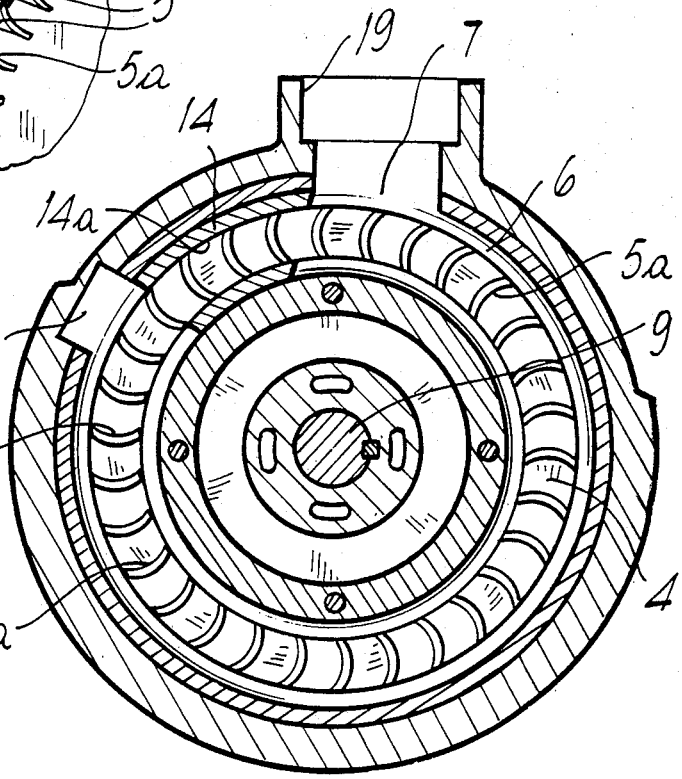
FIG. 3 is a sectional view of FIG. 1 taken along the axis III—III.

With reference to the above figures, the pump according to the invention, generally indicated by the reference numeral 1, comprises a body 2 which accommodates an impeller 4 so that it can rotate about a main axis 3; said impeller is substantially disk-shaped and has, on at least one of its faces, a plurality of radial blades 5 arranged along a peripheral circular ring which is concentric to the main axis 3. The blades 5 are accommodated in an annular duct 6 which extends in the body 2 concentrically to the main axis 3 and is delimited, in an axial direction, by the face of the impeller which bears the blades 5. The annular duct 6 has an intake port 7 and a delivery port 8 which are angularly spaced with respect to the axis 3 and are intended to be connected to respective ducts of a known refrigerating circuit which is not illustrated for the sake of simplicity.

According to the invention, the annular duct 6 is closed in an axial direction, except for the regions defining the ports 7 and 8, and has a portion with reduced cross section in a radial direction, so that when the impeller rotates about the main axis 3, the working fluid advances along the annular duct 6 so as to form vortices about the ideal circumference defined by the center line of said annular duct.

More particularly, the impeller 4 is keyed to a shaft 9 which is supported, by means of a pair of bearings 10 and 11, so that it can rotate about its axis, which coincides with the main axis 3. Said shaft 9 is rigidly associated in a known manner with the output shaft 12 of a known electric motor 13 which is not described in further detail for the sake of simplicity.

The blades 5 are advantageously curved, with a concavity **5*a*** directed concordantly with the direction of rotation of the impeller.

The annular duct 6 conveniently has a substantially toroidal configuration having a base which is tangent to the face of the impeller 4 which bears the blades 5, so as to facilitate the vorticose motion of the working fluid, and its passage section decreases, e.g. in its radial extension, from the intake port 7 towards the delivery port 8.

Said annular duct 6 has a dividing wall 14 placed between the delivery port 8 and the intake port 7 according to the direction of rotation of the impeller. A passage **14*a* is provided in said dividing wall 14 and has a reduced cross section with respect to the remaining part of the annular duct 6 to allow just the blades 5** to pass during the rotation of the impeller.

In the illustrated embodiment, the impeller 4 has blades 5 on each of its two faces, and two annular ducts 6 and 15 are arranged symmetrically with respect to the impeller 4.

A second impeller 16, substantially equal to the previously described impeller 4, is furthermore keyed on the shaft 9; two other annular ducts 17 and 18, shaped substantially like the annular duct 6, are provided at the blades of the impeller 16.

In practice, the pump in the illustrated embodiment has two compression stages arranged in series, and the delivery ports of the annular ducts 6 and 15 are connected, through a duct defined inside the body 2 and not illustrated for the sake of simplicity, to the intake ports of the annular ducts 17 and 18 of the second compression stage. In this case the annular ducts 17 and 18 have narrower working-fluid passage sections than the annular ducts 6 and 15 of the first stage.

The intake ports of the annular ducts 6 and 15 are connected to a first hole 19 which is formed in the body 2 and to which a duct of the refrigeration system is to be connected, and the intake ports of the annular ducts 17 and 18 may be connected to a second hole 20 which is to be connected to a duct which conveys into said annular ducts a part of the working fluid to be processed only with the second stage of the pump. The delivery ports of the annular ducts 17 and 18 are connected to a third hole 21, which is defined in the body 2 like the preceding one and to which a duct which feeds the condenser of the refrigerating system is connected.

The annular ducts advantageously have a peripheral region which is arranged on the opposite side with respect to the main axis and does not accommodate the blades 5; any condensed fluid collects in this region and thus does not interfere with the blades 5 during their rotation.

A path 22 for the working fluid is conveniently defined inside the body 2 and extends through the regions of the pump (such as for example the bearings) which have elements which move with respect to one another so as to lubricate and cool them. The path 22 extends from a hole 23 which is defined in the casing of the electric motor and through which the working fluid, drawn from the refrigerating circuit after the condenser, is introduced; after affecting the elements to be lubricated, said path leads proximate to the intake ports of the annular ducts 17 and 18.

For the sake of completeness in description, it should be mentioned that the body 2 may have cooling fins 24 on its outer surface.

The operation of the pump according to the invention is as follows.

The working fluid is sucked in through the intake ports of the annular ducts 6 and 15, is compressed in said ducts by the action of the impeller and is pushed towards the delivery ports. During this advancement, the fluid moves vortically about the circumference defined by the annular ducts and in practice describes spirals, making contact with the blades 5 several times. The compressed fluid is subsequently sucked by the impeller of the second stage and is further compressed.

In practice it has been observed that the pump according to the invention fully achieves the intended aim since, by having a high pumping capacity, it allows to obtain higher pressure differences with respect to known centrifugal or axial pumps, for a same peripheral speed of the impeller, and can therefore be provided with a reduced number of stages and actuated with reduced-weight electric motors.

Though the pump according to the invention has been conceived in particular for aeronautical applications, it may naturally be used more generally for any refrigerating system.

The pump thus conceived is susceptible to numerous modifications and variations, all of which are within the scope of the inventive concept; all the details may furthermore be replaced with technically equivalent elements.

In practice the materials employed, as well as the dimensions, may be any according to the requirements and to the state of the art.

We claim:

1. A pump for refrigerating systems, comprising a pump body defining a main axis, at least one substantially disk-shaped impeller being rotatably supported by said pump body and having at least one blade bearing face, said impeller being rotatable about said main axis of said pump body, said at least one blade bearing face lying in a plane which is substantially perpendicular to said main axis, a plurality of radial blades being formed on said at least one blade bearing face and extending perpendicularly therefrom in a direction substantially parallel to said main axis, said plurality of radial blades being arranged along a circular ring concentric to said main axis, at least one annular duct extending in said pump body, said at least one annular duct extending concentrically to said main axis and being arranged such that said at least one blade bearing face of said at least one impeller delimits one side of said at least one annular duct, said plurality of radial blades extending into and being accommodated in said at least one annular duct, said at least one annular duct having an intake port and a delivery port, said intake port allowing for fluid inflow into said at least one annular duct and said delivery port allowing for fluid outflow out of said at least one annular duct, each blade of said plurality of blades having a curved configuration, a concavity being defined by said curved configuration of said each blade, said concavity being directed along a rotation direction of said impeller, said at least one annular duct having a cross-section with a substantially elongated toroidal configuration with a base which is tangent to said at least one blade bearing face, whereby rotation of said at least one impeller causes fluid to advance along said at least one annular duct thereby forming vortices about a circumference formed by a middle line of said at least one annular duct from said intake port to said delivery port.

2. Pump according to claim 1, wherein said at least one annular duct has a cross-section which decreases from said intake port to said delivery port along a rotation direction of said impeller.

3. Pump according to claim 1, wherein said at least one impeller has a second blade bearing face carrying a second plurality of blades which extend into and which are accommodated in a second annular duct provided in said pump body, said second annular duct being substantially equal to said at least one annular duct.

4. Pump according to claim 1, wherein said at least one annular duct has a separation wall for dividing said intake port from said delivery port, said separation wall extending from said delivery port to said intake port along a rotation direction of said impeller.

5. Pump according to claim 1, comprising a refrigerating path being defined inside said pump body and extending through mutually moving elements of said pump, said refrigerating path being fed with refrigerating fluid and leading to said intake port.

6. Pump according to claim 1, comprising two pumping stages, each stage of said two pumping stages comprising one said at least one impeller bearing two pluralities of blades, each one of said two pluralities of blades being arranged on one of two mutually opposite faces of said one said at least one impeller, said each one of said two pluralities of blades extending in one said at least one annular duct, said two pumping stages being arranged side-by-side, said delivery port of one said two pumping stages communicating with said intake port of other one of said two pumping stages.

7. Pump according to claim 1, wherein said at least one annular duct has an outer peripheral region external to said plurality of blades for processing a liquid phase of refrigerating fluid.

* * * * *